United States Patent [19]

Clausen et al.

[11] Patent Number: 4,964,974

[45] Date of Patent: Oct. 23, 1990

[54] MICROSCOPIC EXAMINATION OF EBULLATED BED PROCESS EFFLUENT TO CONTROL SEDIMENT

[75] Inventors: Glenn A. Clausen, Nederland; Karen A. Kuhn, Port Arthur; Kathryn P. Weldon, Sour Lake, all of Tex.

[73] Assignee: Texaco Inc., White Plains, N.Y.

[21] Appl. No.: 438,274

[22] Filed: Nov. 20, 1989

Related U.S. Application Data

[63] Continuation-in-part of Ser. No. 269,529, Nov. 10, 1988, abandoned.

[51] Int. Cl.[5] ..... C10G 47/26

[52] U.S. Cl. ..... 208/108; 208/48 AA; 208/112; 208/157

[58] Field of Search ..... 208/108, 112, 157, 177, 208/DIG. 1, 48 AA; 436/60, 139

[56] References Cited

U.S. PATENT DOCUMENTS

| | | | |
|---|---|---|---|
| 2,732,285 | 1/1956 | Lynch et al. | 436/60 |
| 2,809,153 | 10/1957 | Bacsik et al. | 208/177 |
| 4,158,622 | 6/1979 | Schwarzenbek | 208/177 |
| 4,238,451 | 12/1980 | Ciais et al. | 436/139 |
| 4,470,900 | 9/1984 | Kydd | 208/177 |
| 4,751,187 | 6/1988 | Dickakian | 436/139 |
| 4,762,797 | 8/1988 | Dickakian | 436/60 |

*Primary Examiner*—Anthony McFarlane

*Attorney, Agent, or Firm*—Jack H. Park; Kenneth R. Priem; Richard A. Morgan

[57] ABSTRACT

In a ebullated bed process, a residual hydrocarbon oil is hydrotreated at a reaction temperature of 750° F. to 875° F. and pressure of 1500 psig to 10,000 psig in a single or multiple reaction zone. A sample of hydrotreated liquid effluent is flash separated to obtain a nominal 650° F.+ liquid which is magnified to 100×. Area precent, average diameter and maximum size of insoluble agglomerates is measured from the magnified view. Reactor temperature is varied with the area percent, average diameter and maximum size of insoluble agglomerates to control downstream sediment formation and plug formation at an acceptable level.

6 Claims, 2 Drawing Sheets

MICROSCOPIC EXAMINATION OF EBULLATED BED PROCESS EFFLUENT TO CONTROL SEDIMENT

CROSS-REFERENCE TO RELATED APPLICATION

This application is a continuation-in-part of Application Ser. No. 07/269,529 filed Nov. 10, 1988 now abandoned for Microscopic Examination Of Ebullated Bed Process Effluent To Control Sediment.

BACKGROUND OF THE INVENTION 1. Field of the Invention

This invention relates to an improved ebullated bed process. In the improved process, nominal 650° F. + reactor effluent is examined by means of a microscope, the size and area percent of insoluble agglomerates is determined and reactor temperature adjusted therefrom. 2. Description of Other Relevant Methods in the Field The ebullated bed process comprises the passing of concurrently flowing streams of liquids or slurries of liquids and solids and gas through a vertically cylindrical vessel containing catalyst. The catalyst is placed in random motion in the liquid and has a gross volume dispersed through the liquid medium greater than the volume of the mass when stationary. The ebullated bed process has found commercial application in the upgrading of heavy liquid hydrocarbons such as vacuum residuum or atmospheric residuum or converting coal to synthetic oils.

The ebullated bed process is generally described in U.S. Pat. No. Re. 25,770 issued Apr. 27, 1965 to E. S. Johanson.

U.S. Pat. No. 3,948,756 to R. H. Wolk et al. teaches pentane insoluble asphaltene removal in an ebullated bed process. In the process a residual oil feedstock is passed upwardly through a reaction zone containing a hydrogenation catalyst and a hydrogen rich gas at a temperature of 700° F. to 800° F. and a hydrogen partial pressure of 1000 psig to 3000 psig. Space velocity is 0.1 to 2.0 volume of feed per hour per reactor volume.

U.S. Pat. No. 4,457,830 to R. H. Kydd teaches the acid precipitation of preasphaltenes in an ebullated bed process. In the process preasphaltenes are precipitated from a bottoms fraction boiling above about 950° F. by precipitation with 3 to 10 weight percent of a selected acid.

U.S. Pat. No. 3,681,231 to S. B. Alpert et al. teaches an ebullated bed process in which the feed is mixed with a hydrocarbon diluent in a ratio of about 20 to 70 volume percent. The diluent of specified quality is said to improve the fouling of exchanger surfaces, pipe surfaces, valves and vessel walls.

U.S. Pat. No. 3,841,981 to E. T. Layng teaches an ebullated bed process for the hydrogenation of tar sand bitumen. Coke precursors are eliminated in a quenching stage.

Analytical methods are taught in U.S. Pat. Nos. 4,751,187; 4,752,587 and 4,388,408.

SUMMARY OF THE INVENTION

The invention is an improvement in an ebullated bed process which hydrocracks a residual hydrocarbon oil in the presence of a particulate catalyst. The process comprises passing the residual oil along with a hydrogen-containing gas upwardly through a zone of ebullated hydrogenation catalyst at a reaction temperature of 750° F. to 875° F. The pressure is about 1500 psig to 10,000 psig and space velocity is 0.1to 1.5 volume of oil per hour per volume of reactor. Hydrocarbon effluent is withdrawn from the zone of hydrogenation catalyst and flash separated to yield a nominal 650° F.+ liquid.

A sample of nominal 650° F.+ liquid is taken and examined by means of a microscope to form a magnified view at 60X to 175X preferably 100X. The size, and area percent coverage of the insoluble agglomerates in the magnified view are determined. If the area percent coverage of the magnified view is greater than about 37 to 45, which correspond to a maximum agglomerate size of 600 to 800 microns and an average diameter greater than 29 to 35 microns, the reaction temperature is reduced. Plugging of downstream equipment is controlled thereby.

DETAILED DESCRIPTION OF THE INVENTION

In the ebullated bed process operated at high conversion, insoluble agglomerate formation increases as processing severity increases. Attempts have been made to measure concentration of these insoluble agglomerates directly by a modified ASTM spot test. The concentration of agglomerates has also been measured by filtering techniques such as the Institute de Petrole Sediment Test IP 375/86 and by solvent extraction techniques for pentane, heptane, and toluene insoluble components. These techniques have not proven completely satisfactory for control purposes due to analysis time or reproducibility.

The inventive method measures the quantity and size of insoluble agglomerates in the 650° F.+ product liquid fraction and uses the measurement to control ebullated bed temperature. When viewed with an image processing microscope on a black and white monitor, the agglomerates appear black in color. The surrounding soluble oil appears light gray in color. An image processing microscope such as an Artek Omnicon 3600 forms a magnified view of the sample and is able to detect and measure the dark insoluble agglomerates in the light gray soluble material.

The image processing microscope measures the average diameter, maximum size, and area percent coverage of agglomerates by means of a microprocessor. The diameter length across each insoluble agglomerate is measured at one degree increments around the insoluble agglomerate. The average diameter of each insoluble agglomerate is the average diameter length measured at one degree increments around the center of the insoluble agglomerate. The average diameter of all agglomerates is the summation of the average diameter of each insoluble agglomerate divided by the total number of insoluble agglomerates. The maximum size is the longest diameter length of any insoluble agglomerate in the sample. The area percent of coverage is the percent of the total viewed area covered by the insoluble agglomerates, i.e. (area of insoluble agglomerates/total area) X 100%.

The average diameter, maximum size, and area percent coverage can alternatively be determined by manual and optical techniques such as with a cross-hatch lens or planimeter or by manual measurement from a photograph of the magnified sample. These manual and optical techniques give equivalent results.

EXAMPLE

FIGS. 1–4 show data taken on an image processing microscope at 100X magnification of the nominal 650° F.+ flash liquid product from a two-stage ebullated bed process pilot unit. Circled points indicate that downstream control valve plugging was observed. These data were taken from two studies conducted at different space velocity and recycle rate and with different feedstocks described in Tables I and II.

Figure 1:
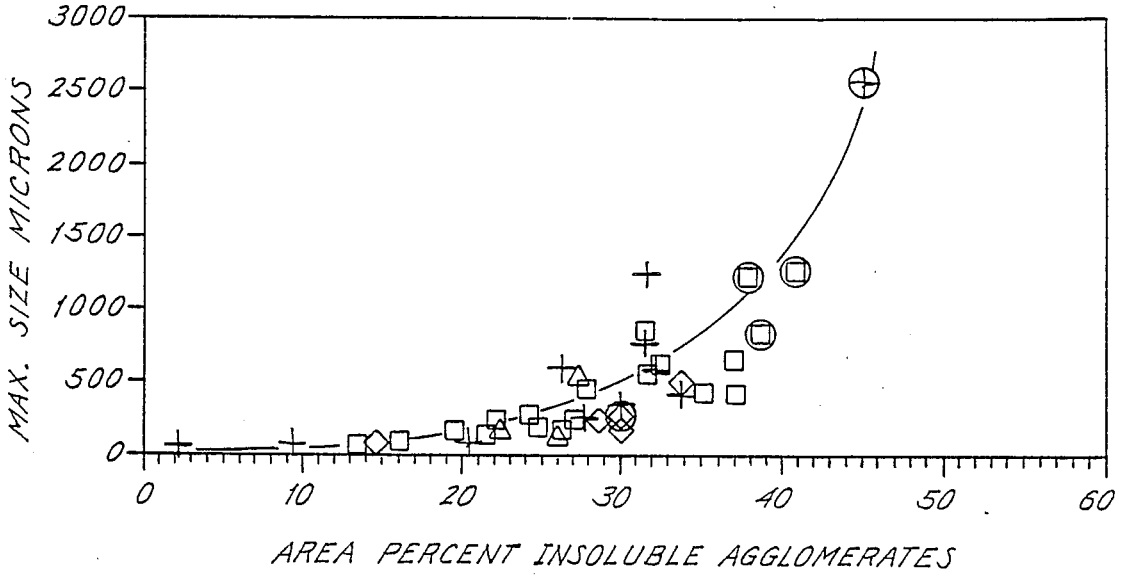
FIG. 1 is a graph of the maximum size of insoluble agglomerates versus area percent coverage of the magnified view by insoluble agglomerates.
Figure 2:
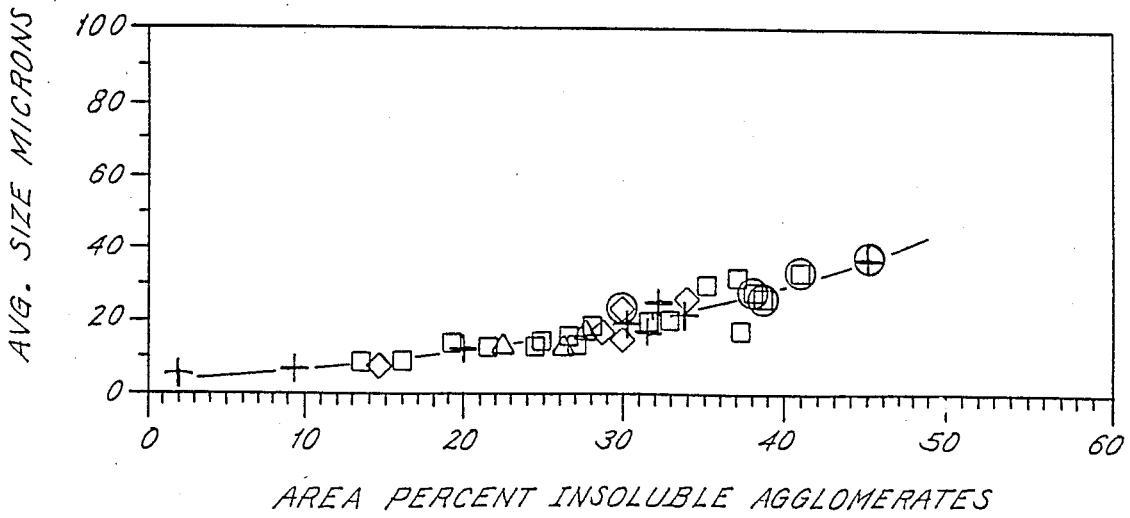
FIG. 2 is a graph of average size of insoluble agglomerates versus area percent coverage of the magnified view by insoluble agglomerates.
Figure 3:
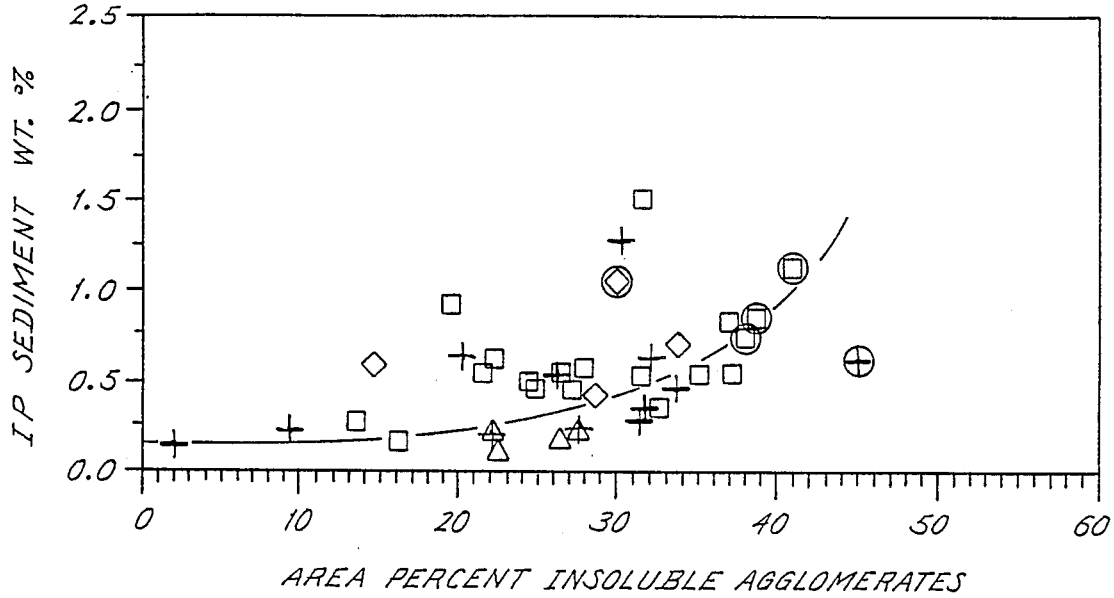
FIG. 3 is a graph of weight percent sediment by Institute de Petrole Sediment Test IP 375/86 versus area percent coverage of the magnified view by insoluble agglomerates.

As shown in FIGS. 1 and 2, control valve plugging due to agglomeration occurred at a particle coverage of the field greater than about 37 area percent which corresponds to a maximum agglomerate size greater than about 800 microns (FIG. 1) and an average diameter greater than about 29 microns (FIG. 2). FIG. 3 shows the comparison between sediment content by IP 375/86 and the field coverage by insolubles for the same set of data shown in FIGS. 1 and 2. Control valve plugging occurred at an insoluble agglomerate coverage greater than 37 area percent 100% of the time. One control valve plugging data point occurred at insoluble agglomerates coverage of less than 37 area percent. In contrast, control valve plugging occurred 44% of the time when the IP sediment was greater than 0.7 wt% for the set of data shown in FIGS. 1–3. Control valve plugging also occurred once at a sediment content of 0.6 wt%.

Figure 4:
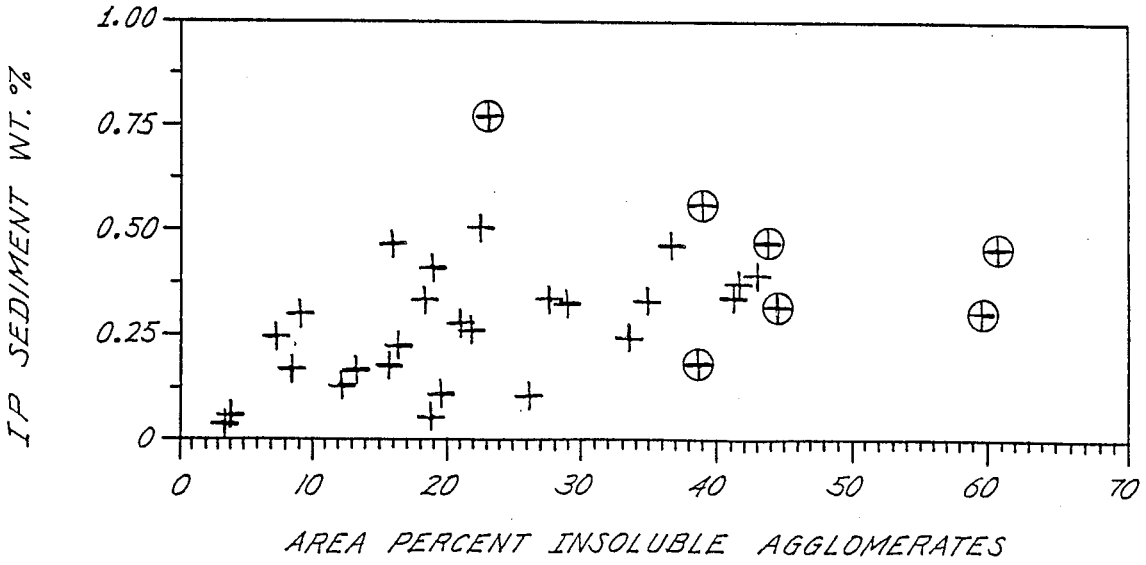
FIG. 4 is a graph of weight percent sediment by Institute de Petrole Sediment Test IP 375/86 versus area percent coverage of the magnified view by insoluble agglomerates.

FIG. 4 shows data from a second study. Control valve plugging occurred 67% of the time when the insoluble agglomerate coverage was greater than 37 area percent, but only once when the coverage was less than 37 area percent. For this feedstock control valve plugging did not correlate well with sediment content.

The maximum size (FIG. 1) and average size (FIG. 2) of the insoluble agglomerates predicted control valve plugging better than sediment content (FIG. 3). At maximum sizes greater than 800 microns, control valve plugging occurred 67% of the time in the set of data shown in FIG. 1, which is better than the 44% accuracy of the IP 375/86 sediment method. Likewise, control valve plugging occurred 57% of the time when the average size was greater than 29 microns, which is also better than the accuracy of the IP 375/86 sediment method. Due to the relative size of process equipment, a higher threshold of area coverage, maximum size and average diameter of the insoluble agglomerates could be tolerated on a commercial scale u it before plugging would occur. On a commercial scale unit, 37 to 45 area percent coverage, 800 to 1000 micron maximum size and 29 to 35 microns average diameter are the tolerable limits.

TABLE I

| | FEEDSTOCK PROPERTIES | |
|---|---|---|
| Description<br>Crude Source | FIGS. 1, 2 and 3<br>Vacuum Residuum VIII<br>Arabian Medium<br>Alaskan North Slope<br>Arabian Berri<br>(percentages unknown) | FIG. 4<br>Vacuum Residuum V<br>54 vol % Arabian Medium<br>37 vol % Alaskan North Slope<br>9 vol % Arabian Berri |
| API Gravity (ASTM D-287), °API | 6.5 | 5.0 |
| 1000° F.+, vol %<br>(by vacuum distillation) | 91.4 | 93.2 |
| X-ray Sulfur, wt % (ASTM D-4294) | 4.36 | 4.09 |
| Total Nitrogen, wppm<br>(Chemiluminescence) | 5950 | 5273 |
| Carbon Residue, wt % (ASTM D-4530) | 21.9 | 21.2 |
| Kinematic Viscosity, cSt (ASTM D-445) | | |
| @ 212° F. | 2992 | 1512 |
| @ 250° F. | 796 | 452 |
| @ 300° F. | 204 | 125 |
| Pentane Insolubles, wt %<br>(by solvent extraction) | 29.1 | 25.8 |
| Heptane Insolubles, wt %<br>(by solvent extraction) | 11.0 | 7.8 |

TABLE II

| | Ebullated Bed Process Parameters | |
|---|---|---|
| FEEDSTOCK | FIGS. 1, 2, AND 3<br>Vacuum Residuum VIII | FIG. 4<br>Vacuum Residuum V |
| Nominal Liquid Hourly Space Velocity<br>(Voil/Vrx*hr) | 0.034 | 0.15–0.31 |
| Average Reactor Temperature, °F. | 790 | 770–790 |
| Throughout Ratio<br>(Vff-Vrec)/(Vff) | 1.0 | 1.0–1.5 |

Voil - Volume of nominal 1000° F.+ boiling range material
Vrx - Volume of the hydrocracking zone of the reactor
Vff - Volume of nominal 1000° F.+ boiling range material charged to the hydrocracking zone per hour
Vrec - Volume of recycled 1000° F.+ unconverted product charged to the hydrocracking zone per hour

LEGEND FOR FIGURES

+ First reactor average temperature is the same as the second reactor average temperature. In FIGS. 1, 2 and 3 this temperature averages 790° F. In FIG. 4 this temperature averages 770°-790° F.

Δ First reactor average is 785° F. Second reactor average temperature is 795° F.

□ First reactor average temperature is 780° F. Second reactor temperature is 800° F.

◇ First reactor average temperature is 770° F. Second reactor temperature is 810° F.

○Downstream control valve plugging.

Average temperature for each reactor is determined by averaging the temperatures of ten thermocouples at different heights in the reactor. The ebullated bed reactor temperature is nearly isothermal.

The size and area percent coverage of insoluble agglomerates is highly variable. The inventive method is therefore in its best mode contemplated as a feedback control method wherein reaction temperature is adjusted in response to the amount of insoluble agglomerates present. The amount of adjustment in reaction temperature depends on the size and area percentage of insoluble agglomerates.

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A method for hydrocracking a residual hydrocarbon oil by treating the oil with hydrogen in the presence of a particulate catalyst in an ebullated bed, the steps comprising:

(a) passing the residual oil, and a hydrogen-containing gas upwardly through an ebullated bed of the catalyst in a hydrocracking zone at a reaction temperature in the range of 750° to 875° F. and pressure in the range of about 1500 psig to 10,000 psig thereby forming a hydrocracked product, (b) withdrawing a sample of the hydrocracked product, and (c) forming a 60X to 175X magnified view of the sample by means of a microscope, (d) measuring the area percent covered by insoluble agglomerates of the magnified view of the sample, (e) controlling the reaction temperature to maintain a selected area percent covered by insoluble agglomerates in the range of 37 to 45 area percent, thereby (f) reducing plugging in downstream equipment due to insoluble agglomerates.

2. A method as recited in claim 1 wherein step (b) additionally comprises flash separating the sample to produce a nominal 650° F+ liquid, and using the separated nominal 650° F. + liquid in step (c).

3. A method for hydrocracking a residual hydrocarbon oil by treating the oil with hydrogen in the presence of a particulate catalyst in an ebullated bed, the steps comprising:

(a) passing the residual oil, and a hydrogen-containing gas upwardly through an ebullated bed of the catalyst in a hydrocracking zone at a reaction temperature in the range of 750° F. to 875° F. and pressure in the range of about 1500 psig to 10,000 psig thereby forming a hydrocracked product, (b) withdrawing a sample of the hydrocracked product, and (c) forming a 60X to 175X magnified view of the sample by means of a microscope, (d) measuring the average diameter of insoluble agglomerates in the magnified view of the sample, (e) controlling the reaction temperature to maintain a selected average diameter of insoluble agglomerates in the range of 29 microns to 35 microns, thereby (f) reducing plugging in downstream equipment due to insoluble agglomerates.

4. A method as recited in claim 3 wherein step (b) additionally comprises flash separating the sample to produce a nominal 650° F.+ liquid, and using the separated nominal 650° F.+ liquid in step (c).

5. A method for hydrocracking a residual hydrocarbon oil by treating the oil with hydrogen in the presence of a particular catalyst in an ebullated bed, the steps comprising:

(a) passing the residual oil, and a hydrogen-containing gas upwardly through an ebullated bed of the catalyst in a hydrocracking zone at a reaction temperature in the range of 750° F. and pressure in the range of about 1500 psig to 10,000 psig thereby forming a hydrocracked product, (b) withdrawing a sample of the hydrocracked product, and (c) forming a magnified view of the sample by means of a microscope, (d) measuring the maximum size insoluble agglomerate in the magnified view of the sample, (e) controlling the reaction temperature to maintain the maximum size insoluble agglomerate in the range of 800 to 1000 microns, thereby (f) reducing plugging in downstream equipment due to insoluble agglomerates.

6. A method as recited in claim 5 wherein step (b) additionally comprises flash separating the sample to produce a nominal 650°F+ liquid, and using the separated nominal 650°+ liquid in step (c).

* * * * *